United States Patent [19]

Sueyoshi et al.

[11] 3,960,568

[45] June 1, 1976

[54] PHOTOGRAPHIC MATERIAL CONTAINING FINE SILVER HALIDE PARTICLES AND HYDROXYLAMINO SUBSTITUTED TRIAZINE OR PYRIMIDINE SENSITIZERS

[75] Inventors: Tohru Sueyoshi; Yoshiyuki Nakazawa; Yoshuhara Nakamura; Reiichi Ohi; Tokiharu Kondo, all of Minami-ashigara, Japan

[73] Assignee: Fuji Photo Film Co., Ltd., Minami-ashigara, Japan

[22] Filed: Nov. 18, 1975

[21] Appl. No.: 524,859

[30] Foreign Application Priority Data

July 17, 1971 Japan ..... 46-53318

[52] U.S. Cl. ..... 96/76 R; 96/100; 96/107; 96/120

[51] Int. Cl.[2] ..... G03C 1/48; G03C 1/28; G03C 1/40; G03C 1/02

[58] Field of Search ..... 96/94 R, 76 R, 107

[56] References Cited

UNITED STATES PATENTS

| | | | |
|---|---|---|---|
| 2,080,019 | 5/1937 | White | 96/111 |
| 3,415,650 | 12/1968 | Frame et al. | 96/94 R |
| 3,645,743 | 2/1972 | Mucke et al. | 96/111 |
| 3,905,821 | 9/1975 | Ohtani et al. | 96/107 |

FOREIGN PATENTS OR APPLICATIONS

| | | | |
|---|---|---|---|
| 2,046,683 | 4/1971 | Germany | 96/107 |

*Primary Examiner*—David Klein
*Assistant Examiner*—Richard L. Schilling
*Attorney, Agent, or Firm*—Sughrue, Rothwell, Mion, Zinn & Macpeak

[57] ABSTRACT

A silver halide photographic material having increased sensitivity and gradient and being free from fog formation on storage, comprising a support and an emulsion layer containing very fine silver halide grains and containing a nitrogen-containing heterocyclic organic compound having a hydroxylamino group, such as 2-hydroxylamino-4,6-di(ethylamino)-1,3,5-triazine or 2,4-di(hydroxylamino)-6-diethylamino-1,3,5-triazine. The photographic material is useful for recording fine images with a superior sharpness, and the incorporation of the heterocyclic compound increases the sensitivity in spite of the fine grain size of the silver halide.

18 Claims, No Drawings

PHOTOGRAPHIC MATERIAL CONTAINING FINE SILVER HALIDE PARTICLES AND HYDROXYLAMINO SUBSTITUTED TRIAZINE OR PYRIMIDINE SENSITIZERS

BACKGROUND OF THE INVENTION

1. Field of the Invention

This invention relates to a sensitized silver halide photographic material. More particularly, this invention relates to a silver halide photographic material containing sensitized fine silver halide crystals.

2. Description of the Prior Art

A photographic material containing fine silver halide particles, for example, those having an average diameter of 0.1 micron, is useful for recording minute images since images having a very small granularity and a superior sharpness can be obtained. However, the sensitivity of such a photographic material is generally lower than that of a photographic material containing relatively larger silver halide particles, for example, those having an average diameter of 0.6 micron, because the sensitivity of a silver halide photographic material generally tends to increase with larger sizes of silver halide particles. In general, therefore, the use of a photographic material containing fine silver halide particles requires large quantities of exposue and thus, a light source of a large luminous intensity or long exposure time, and this has set great limitation on the use of photographic materials containing fine silver halide particles. It is of great importance to increase the sensitivity of photographic materials containing fine silver halide particles to a level which is feasible for practical purposes.

Many methods have previously been known for increasing the sensitivity of a silver halide photographic material without increasing the particle size of the silver halide.

Among these are a method in which a sulfur compound such as sodium thiosulfate, a noble metal compound such as gold chloride, or other reducing agent such as tin chloride is added during the process of chemical ripening of a silver halide photographic emulsion, and a method in which immediately prior to coating, a quaternary ammonium salt-type compound, such as an alkyl pyridinium chloride or a polyoxyalkylene compound is added to a photographic emulsion.

These known sensitizing methods, however, cannot effect a sufficient elevation of the sensitivity without adversely affecting the photographic material containing the fine silver halide particles. Even when great sensitizing effects are obtained using these methods, a decrease in radient or fog may occur during storage of the photographic material.

A primary object of this invention is to provide a silver halide photographic material containing very fine silver halide particles in the photographic layer and having a high sensitivity.

A further object of this invention is to provide a photographic material containing fine silver halide particles which has a high sensitivity and a high gradient.

Another object of this invention is to provide a photographic material containing fine silver halide particles which has a high sensitivity and is free from fog during storage.

SUMMARY OF THE INVENTION

The sensitivity of a photographic material containing fine silver halide particles can be markedly increased by incorporating a heterocyclic compound containing a hydroxylamino substituent into a photographic layer containing fine silver halide particles with an average particle diameter not in excess of 0.35 micron or containing fine silver halide particles at least 90% of which have a particle diameter not in excess of 0.4 micron. It has been found that such a photographic layer does not have a decrease in gradient with increasing sensitivity, nor does fog occur during storage.

This invention is achieved by adding an appropriate amount of a nitrogen-containing heterocyclic compound having a hydroxylamino group as a substituent to a photographic emulsion of fine silver halide particles, preferably, which have already been sensitized or to a hydrophilic substance layer adjoining the silver halide emulsion layer directly or via some other hydrophilic substance layer.

DETAILED DESCRIPTION OF THE INVENTION

As the compound to be incorporated in the photographic emulsion, heterocyclic compounds of the following general formula are especially effective:

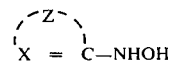

wherein Z represents an atomic grouping necessary for forming a heterocyclic ring with the

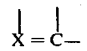

moiety of said formula and contains at least one nitrogen atom and X represents a nitrogen atom or a methine group (—CH=).

There are various nitrogen-containing hetero rings formed by the Z atomic grouping. But compounds containing a triazine ring, a triazine ring which is a part of a fused ring system (e.g.) a benzene ring as a part of a fused ring system, a pyrimidine ring, or a pyrimidine ring which is a part of a fused ring system (e.g.) a triazole ring or pyrazole ring as a part of a fused ring system are easy to synthesize and exhibit superior effects.

That is, heterocyclic compounds of the following general formula ($II_a$), ($II_b$), ($III_a$), ($III_b$), or ($III_c$) are especially effective:

Triazine Type

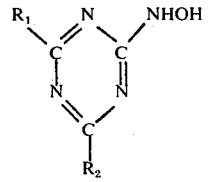

($II_a$)

wherein $R_1$ and $R_2$ each represents a hydrogen atom, a hydroxy group, a halogen atom (e.g. a chlorine atom, a bromine atom), an alkyl group (e.g. a methyl group, an ethyl group, a propyl group, a butyl group, etc.), an alkoxy group (e.g. a methoxy group, an ethoxy group, etc.), an aryl group (e.g. a phenyl group), or an optionally substituted amino group {e.g. an amino group, a hydroxyamino group, an alkylamino group (e.g. a methylamino group, an ethylamino group), a dialkylamino group (e.g. a di-methylamino group, a diethylamino group), an arylamino group (e.g. a phenylamino group)}.

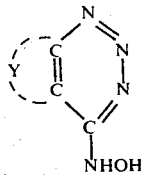

($II_b$)

wherein Y represents a benzene ring.

Pyrimidine Type

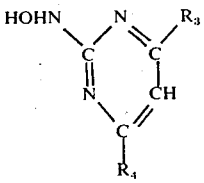

($III_a$)

wherein $R_3$ and $R_4$ each represents a hydrogen atom, a hydroxy group, an alkyl group (e.g. a methyl group, an ethyl group, a propyl group, a butyl group), an alkoxy group (e.g. a methoxy group, an ethoxy group), an aryl group (e.g. a phenyl group), or an optionally substituted amino group {e.g. an amino group, an alkylamino group (e.g. a methylamino group, an ethylamino group), a hydroxyamino group}.

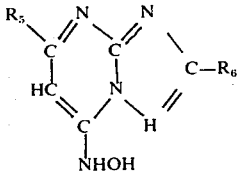

($III_b$)

wherein $R_5$ has the same meaning as $R_3$ and $R_4$, and $R_6$ represents a hydrogen atom, an alkyl group (e.g. a methyl group, an ethyl group), an aralkyl group, or an aryl group (e.g. a phenyl group).

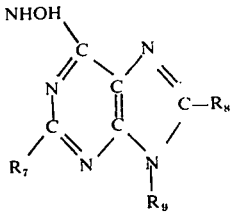

($III_c$)

wherein $R_7$ has the same meaning as $R_3$ and $R_4$, $R_8$ has the same meaning as $R_6$ and $R_9$ represents a hydrogen atom, an optionally substituted alkyl group {e.g. a methyl group, an ethyl group, an alkoxyalkyl group (e.g. a methoxyethyl group), an aralkyl group (e.g. a phenylethyl group)}, or a hydroxy group.

Specific examples of the nitrogen-containing heterocyclic compound containing a hydroxylamino group which can be used in the present invention are shown below. These compounds can be used alone or in admixture. It should be understood that the compounds which can be used in this invention are not limited in any way to these specific examples.

Compound 1

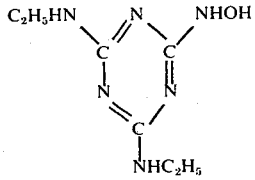

m.p. 194–196°C

Compound 2

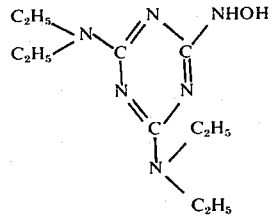

m.p. 146–147°C

Compound 3

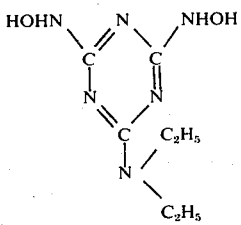

m.p. 190°C

Compound 4

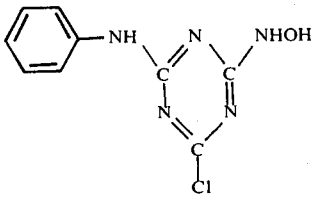

m.p. 105–111°C

Compound 5

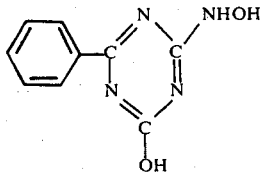

m.p. 250°C

Compound 6

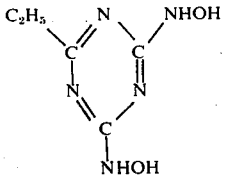

m.p. 208–210°C

Compound 7

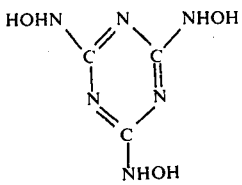

m.p. 205°C (decomp.)

-continued
Compound 8
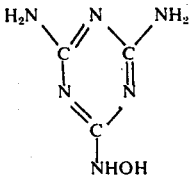
m.p. above 300°C
Compound 9
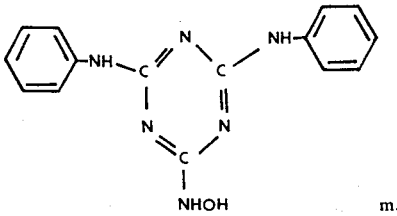
m.p. 175°C
Compound 10
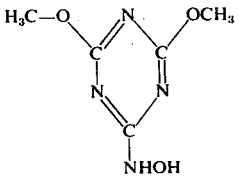
m.p. 172–173°C
Compound 11
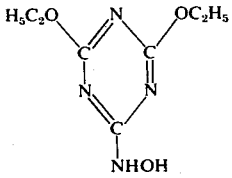
m.p. 68–70°C
Compound 12
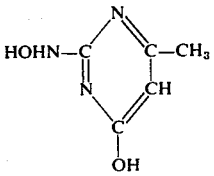
m.p. 233°C (decomp.)
Compound 13
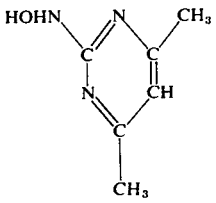
m.p. 209–211°C (decomp.)
Compound 14
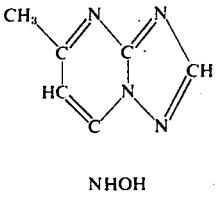
m.p. 275–280°C (decomp.)
-continued
Compound 15
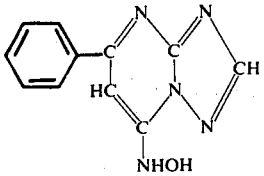
m.p. 324–328°C
Compound 16
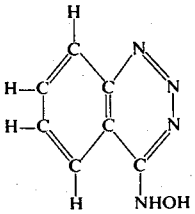
m.p. 175°C
Compound 17
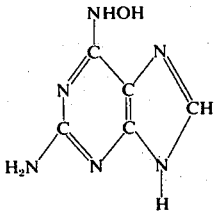
m.p. 310°C
Compound 18
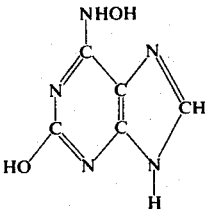
m.p. 355°C
Compound 19
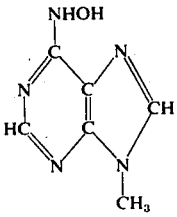
m.p. 244°C
Compound 20
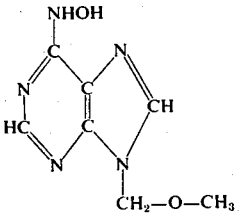
m.p. 185°C
Compound 21
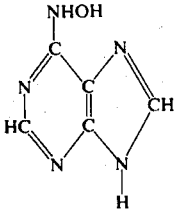
m.p. 252°C These compounds can be prepared by reacting chloro-S-triazine or its substitution products with the corresponding amines, phenols or alcohols. These compounds have been synthesized in accordance with the methods disclosed in the *Journal of the American Chemical Society*, Vol. 73, page 2981 and the *Journal of the Organic Chemistry*, Vol. 27, page 4054.

Typical examples of synthesis will be given below.

EXAMPLE OF SYNTHESIS (COMPOUND 1)

cyanuric trichloride (92.2 g) was dissolved in 200 ml. of dioxane. With good stirring, the solution was poured into 300 ml. of water to make a slurry. The resultant slurry was cooled to 0° – 5°C., and 64.4 g of an aqueous solution of ethylamine (70% by weight) was added dropwise. The mixture was heated to 40°C., and the pH of the reaction mixture was maintained neutral by the addition of 30 ml. of an aqueous solution containing 40 g of sodium hydroxide. After a lapse of 4 hours, the precipitated crystals were recovered by filtration, and washed with water. Hydroxylamine hydrochloride (140 g) was dissolved in 300 ml. of water, and the solution was cooled to 20°C. or below, after which 170 ml. of an aqueous solution containing 80 g of sodium hydroxide was added, under a nitrogen atomosphere, so as to neutralize the solution. To the neutralized solution was added a suspension of the initially synthesized crystals in 500 ml. of dioxane, and the mixture was reacted for 30 minutes at 50°C. and further for 4 hours at 85°C. The insoluble matter was separated by filtration, and when the filtrate was cooled, crystals were precipitated. The crystals were recovered by filtration, and recrystallized from methanol. Crystals having a melting point of 197° to 198°C were obtained.

Compounds 2 to 4 and 7 to 9 were synthesized using the corresponding amines in accordance with substantially the same method as in the preparation of Compound 1.

Compound 5 can be synthesized in a similar manner using 2-phenyl-4,6-dichloro-1,3,5-triazine prepared by the method described in the *Journal of the American Chemical Society*, Vol. 60, page 1657. Compound 6 can also be synthesized using a 2-ethyl derivative. Compounds 12 to 21 can be produced by methods similar to the above by the reaction of the chlorine-substituted products of the corresponding heterocyclic compounds with hydroxylamine.

These compounds can be added to a photographic emulsion as a solution of an organic solvent, for example, alcohols such as methanol, ethanol, propanol, isopropanol, ketones such as acetone, methyl ethyl ketone and esters such as ethyl acetate or as an aqueous solution weakly acidified with an acid such as hydrochloric acid, sulfuric acid and p-toluene sulfonic acid.

Although there is no specific restriction on the point at which this compound is added to an emulsion, it is convenient to add it immediately before coating which follows post ripening.

It is necessary that the silver halide emulsion have an average particle diameter of not more than 0.35 micron, or at least 90% of the total particles should have a particle diameter not in excess of 0.4 micron. In the following description, the emulsion containing fine particles of silver halide means such a photographic emulsion. The particle sizes of the spherical grains are determined by a diameter while those of the other shapes can be determined by a diameter of the equivalent circle to a projected area (See "Empirical Relations Between Sensitometric And Size-frequency Characteristics In Photographic Emulsion Series" by A. P. H. Trivelli and W. F. Smith in *The Photographic Journal*, Vol. LXXIX, pp330—338, 1939). The average particle diameter of the grains can be determined by any one of several kinds of the measurement such as arithmetric average and geometric average. The above-described methods of determining grain size for the present invention are not critical, regardless of the means employed, providing that the particle sizes have the above-defined values.

The effect produced by the above-described compound is barely obtained with a photographic layer having relatively larger silver halide particles (for example, those with a diameter of 0.6 micron) as used in a conventional negative photographic material. In view of this, it is clear that the sensitizing method used in this invention differs from the known sensitizing methods described above.

The silver halide photographic emulsion used in this invention can be one which has been sensitized in advance using a chemical sensitizing method such as noble metal sensitization (as described in U.S. Pat. No. 2,399,083) reduction sensitization (as described in U.S. Pat. Nos. 2,518,698, 2,419,974, and 2,983,610) or sulfur sensitization (as described in U.S. Pat. No. 2,410,689). In such a case, a higher sensitivity can be obtained by the conjoint use of the sensitizing method of this invention and such a conventional sensitizing method. When a spectral sensitizing dye is conjointly used with the heterocyclic compound described above, the sensitivity of the photographic material in a spectral sensitization spectral region can be increased to an even greater degree than in the case of using a spectral sensitizing dye alone.

Furthermore, it has been found that a synergistic sensitizing effect is obtained when the sensitization method of this invention is employed together with a spectral sensitizing organic compound having a large sensitizing effect on a silver halide emulsion of ultrafine particles (as described in the specification of U.S. Ser. No. 38,485, filed May 18, 1970 and Ser. No. 13,774, filed Feb. 24, 1970).

The composition of the silver halide used is not particularly restricted, and any of silver bromide, silver chloride, silver iodide, silver iodobromide, silver chlorobromide, silver iodochloride, and silver iodochlorobromide can be used. Silver bromide and silver iodobromide are preferred on account of a high sensitivity. The weight ratio of the hydrophilic binder to the silver halide can range from 4/1 to 1/5, preferably from 2/1 to 1/3.

The amount of the hydroxylamine group containing compound can vary over a broad range, but a preferred range is from about 10mg to about 10g, especially about 40 mg to about 3 g, per mole of silver. A suitable emulsion coating amount on a support can range from about 20 g to about 500 g per $m^2$ of the support.

A hydrophilic high-molecular-weight substance which is used as a binder medium in the emulsion layer in the practice of this invention is suitably gelatin (i.e., an acid-processed or a lime-processed gelatin used in a conventional photographic material) or other modified gelatins (gelatin derivatives) such as acetylated gelatin or phthalized gelatin. It is also possible to use synthetic polymeric materials such a polyvinyl alcohol, polyacrylic acid, polyacrylamide, or copolymers thereof such as acrylamide-1-vinyl-2-methylimidazole, as acrylamide-1-vinyl-2-methylimidazole acrylic acid and the like. Examples of the hydrophilic high-molecular weight substances are disclosed in U.S Pat. Nos. 3,167,430 and 3,284,207 and also disclosed in U.S. Pat. Nos. 2,461,023, 2,486,190 and 2,811,494, British Pat. No. 646,712 and S.C.I. Ind. Phot; Vol. 24, p. 344,1953.

During the manufacture of the photographic material of this invention, natural surface active agents such as saponin or synthetic surface active agents such as alkylbenzenesulfonic acids or polyoxyalkylene alkyl phenols can be used (See, for example, U.S. Pat. Nos. 3,415,649 and 3,201,252). Known hardening agents such as glyoxal, dimethylol urea, mucochloric acid, tri(ethyleneimino)-S-triazine or dichlorohydroxy-S-triazine can also be used (See, for example, U.S. Pat. Nos. 2,983,619 and 3,325,287). Known stabilizers (See e.g., U.S. Pat. Nos. 2,450,397 and 2,319,090) or antifoggants (See, e.g., U.S. Pat. Nos. 2,403,927 and 2,465,149) can also be incorporated in the emulsion layer in order to prevent changes in the properties or fog on storage. This does not affect the effects obtained by the invention, and photographic materials of desirable properties can be obtained.

The emulsion layer of the photographic material of this invention can also contain various additives such as a toner, an agent for preventing latent image fading, a softener for the emulsion layer (See U.S. Pat. Nos. 2,860,980 and 2,904,434), an anti-curling agent (See, e.g., U.S. Pat. No. 3,547,642), a lubricant, a matting agent, a development accelerator (See, e.g., U.S. Pat. Nos. 2,423,549 and 2,400,532) or an irradiation-preventing dye (See, e.g., U.S. Pat. Nos. 3,483,632 and 2,865,752).

Furthermore, the photographic emulsion layer of fine particles of silver halide can contain color couplers which are used in color photograhic materials. The color couplers can be water-soluble couplers or they can be insoluble and can be added to the emulsion layer as a dispersion (See, for example, U.S. Pat. Nos. 3,409,439, 3,551,155 and 3,551,156 as yellow couplers, U.S. Pat. No. 3,558,319 as magenta couplers and U.S. Pat. No. 3,591,393 as cyan couplers)

The support material of the photographic material of this invention is not restricted in any way. Good effects are obtained by coating such emulsion layer on any support materials such as polyester films, cellulose triacetate films or other film bases, paper bases such as baryta paper, resin-coated paper or synthetic paper, dry glass plate, or metal plates.

The sensitivity of a photographic material having fine silver halide particles can be increased not only by adding the heterocyclic compound described above to a photographic emulsion containing fine particles of silver halide, but also by immersing a support material coated with the emulsion layer and dried, in a solution containing the heterocyclic compound. In the latter case, the compound having the sensitizing ability diffuses into the emulsion layer from the solution in which the photographic material is immersed, and thus gives the same effect as in the case of adding the compound to the emulsion prior to coating.

Furthermore, the same effect as in the present invention is obtained by incorporating the heterocyclic compound described above in a hydrophilic substance layer adjoining the silver halide emulsion layer directly or via some other hydrophilic substance layer.

In this case, the heterocyclic compound added to the hydrophilic substance layer diffuses towards the silver halide emulsion layer while these layers are in the wet condition as a result of coating these layers simultaneously or sequentially, and thus, the same result is produced as if the compound had been added to the silver halide emulsion layer initially.

The present invention will be illustrated in greater detail by reference to the following Examples which are for the purposes of illustration and are in no way intended to limit the scope of the invention.

EXAMPLE 1

A photographic emulsion of gelatin/silver iodobromide having an average particle diameter of 0.06 micron was prepared. This emulsion contained 60.5 g of silver bromide, 0.7 g of silver iodide and 56 g of gelatin per kilogram of emulsion. In the course of preparation, N,N,N'-triethylthiourea was added to the emulsion after removal of the water-soluble salts, and the emulsion was chemically ripened for 80 minutes at 54°C. After chemical ripening, 9 kg of the emulsion was divided into 9 equal portions each weighing 1 kilogram. These portions were designated as A,B,C,D,E,F,G,H and J. Compounds 1, 2, 3, 4, 11, 12, 14 and 15 were added, respectively, to portions B to J in the amounts as indicated in Table 1 below. Each of these compounds was added as a 0.8% or 0.02% by weight methanol solution.

Table 1

| Emulsion Sample | Compound Added | Amounts of Compound Added | Solution Concentration (wt %) |
|---|---|---|---|
| A | None | — | 0.8 |
| B | 1 | 0.95 g | 0.8 |
| C | 2 | 0.8 g | 0.8 |
| D | 3 | 0.7 g | 0.8 |
| E | 4 | 1.6 g | 0.8 |
| F | 11 | 1.3 g | 0.8 |
| G | 12 | 0.35 g | 0.8 |
| H | 14 | 20 mg | 0.02 |
| J | 15 | 30 mg | 0.02 |

Each of the emulsions A to J was coated on a glass support at a rate of 350 cc/m², and dried. The sensitivity of the dried samples to light from a tungsten-filament lamp was measured. Each of the dried samples was exposed for 10 seconds using an optical wedge, and developed for 5 minutes at 20°C. using a developer solution of the following formulation.

| Composition of the Developer | |
|---|---|
| N-Methyl-para-Aminophenol Sulfate | 2 g |
| Sodium Sulfite | 96 g |
| Hydroquinone | 8.8 g |
| Sodium Carbonate Monohydrate | 56 g |
| Potassium Bromide | 5 g |
| Water to make | 1000 cc |

The results obtained in measuring the sensitivity are shown in Table 2. The sensitivity value is the reciprocal of the amount of exposure which will give a photographic density of 1 above a fog value. The values shown in Table 2 are relative values with the sensitivity of Sample A set at 1.

Table 2

| Emulsion Sample | Relative Sensitivity |
|---|---|
| A | 1.0 |
| B | 7.6 |
| C | 1.35 |
| D | 4.9 |
| E | 8.6 |
| F | 1.25 |
| G | 1.8 |
| H | 4.4 |
| J | 2.9 |

As can be seen from the above results, the sensitivity of the photographic material containing ultrafine silver halide particles was markedly increased by the addition of Compound 1,3,4,12,14,or 15. Furthermore, the sensitivity evidently increased due to the addition of Compound 2 or 11. The emulsions tested had the same spectral sensitivity characteristics.

EXAMPLE 2

Using the same photographic emulsion of ultrafine silver iodobromide particles as was used in Example 1, after chemical ripening 6 kg of the emulsion were divided into six portions each weighing 1 kg. To these portions were added a sensitizing dye, 3-allyl-5-[1-(2-carboxyphenyl)-2-(3-ethyl-2-thiazolinylidene)ethylidene] rhodanine, and Compounds 1, 2, 3, 4, and 12 as indicated in Table 3 below.

Table 3

| Emulsion Sample | Sensitizing Dye (g) | Sensitizing Compounds Compound No. | Amounts (g) |
|---|---|---|---|
| a | 0.12 | None | — |
| b | " | 1 | 0.95 |
| c | " | 2 | 0.8 |
| d | " | 3 | 1.1 |
| e | " | 4 | 1.6 |
| f | " | 12 | 0.35 |

Each of these emulsion samples was coated on a glass support in the same manner as shown in Example 1 to form a dry plate. The photographic sensitivities of these dry plate samples to green and blue lights were measured. As a light source, a tungsten-filament incandescent lamp was used, and the measurement of the sensitivity to a blue light or green light was performed by exposing each of the samples through a blue filter having a maximum percent transmission at a wavelength of 434 nm or a green filter having a maximum percent transmission at a wavelength of 535 nm. The former gives the sensitivity in an inherent sensitivity wavelength region of the photographic silver halide emulsion layer, and the latter gives the sensitivity in a spectral sensitization wavelength region of the silve halide emulsion layer. Each of the photographic materials was developed in the same manner as described in Example 1, and the sensitivity of the photographic material was measured. The results obtained are shown in Table 4.

The sensitivity value is the reciprocal of the amount of exposure required to give a photographic density of 0.1 above a fog value. The sensitivity of the sample *a* to blue light or green light is set at 1, and the relative sensitivity values of the other samples are given in the table.

Table 4

| Sample | Relative Sensitivity To Blue Light | To Green Light |
|---|---|---|
| a | 1.00 | 1.00 |
| b | 1.38 | 1.26 |
| c | 1.70 | 1.74 |
| d | 1.86 | 1.86 |
| e | 1.58 | 1.55 |
| f | 1.62 | 1.41 |

By the addition of any of the Compounds 1,2,3,4, and 12, an extreme increase in the sensitivity of the photographic emulsion containing ultrafine silver halide grains was obtained.

EXAMPLE 3

A silver bromide emulsion having an average particle diameter of 0.10 micron was prepared.

One kilogram of this emulsion contained 85 g of silver bromide and 42 g of gelatin. Four kilograms of the emulsion were divided into four portions each weighing 1 kg. Compounds 1, 2 and 3 were added respectively to these portions as shown in Table 5 below, and each of the emulsions was coated on a cellulose triacetate base and dried. The thickness of the coating after drying was 10 microns.

Table 5

| Sample | Compounds Added | Amount (g) |
|---|---|---|
| K | None | — |
| L | (Compound 1) 2-Hydroxylamino-4,6-di-(ethylamino)-1,3,5-triazine | 0.65 |
| M | (Compound 2) 2-Hydroxylamino-4,6-di(di-ethylamino)-1,3,5-triazine | 1.6 |
| N | (Compound 3) 2,4-Di(hydroxylamino)-6-diethylamino-1,3,5-triazine | 1.45 |

The sensitivity of each of the films coated with the emulsions K to N to a tungsten-filament electric lamp was measured. The measurement method and the method of expression were the same as were used in Example 1. The results obtained are shown in Table 6 below.

Table 6

| Samples No. | Relative Sensitivity | Fog |
|---|---|---|
| K | 1.0 | 0.04 |
| L | 4.3 | 0.04 |
| M | 1.2 | 0.05 |
| N | 4.0 | 0.04 |

The sensitivity of the emulsion layers containing Compounds 1 and 3 was elevated to a great degree. With compound 2 also, the sensitivity evidently increased.

EXAMPLE 4

Three silver iodobromide emulsions P, Q and R having an average particle diameter of 0.2 micron, 0.33 and 0.5 micron, respectively, were prepared. One kilogram of each of these emulsion contained 55 g of the silver halide and 28 g of gelatin. The silver halide contained 0.6 mol% of silver iodide.

These emulsions were all chemically sensitized with sodium thiosulfate and chloroauric acid in a chemical ripening step. To 1 kg of each of the emulsions was added 0.95 g of 2-hydroxylamino-4,6-di(ethylamino)-1,3,5-triazine (Compound 1 illustrated above) as a 1% methanol solution. An emulsion sample which did not contain this sensitizing compound was also prepared for the purposes of comparison. Each of these emulsions was coated on a glass support, and the sensitivity of the photographic material obtained was measured. The method of measuring the sensitivity and the method of expressing the results were the same as were used in Example 3. The results obtained are shown in Table 7.

Table 7

| Emulsion Sample | Average Particle Diameter (microns) | Addition of Compound 1 | Relative Sensitivity |
|---|---|---|---|
| P-1 | 0.2 | no | 1.00 |
| P-2 | 0.2 | yes | 1.75 |
| Q-1 | 0.33 | no | 1.00 |
| Q-2 | 0.33 | yes | 1.28 |
| R-1 | 0.5 | no | 1.00 |
| R-2 | 0.5 | yes | 0.98 |

The sensitivities of the Samples P-2, Q-2 and R-2 were those relative to the sensitivities of the Samples P-1, Q-1 and R-1 which are set at 1.00.

The sensitizing effect of Compound 1 on Emulsion P having an average diameter of 0.2 micron was very great. But with increasing average particle diameter, its sensitizing effects became smaller, and the Compound 1 exhibited no sinsitizing effect on the emulsion containing particles with an average particle size of 0.5 micron.

EXAMPLE 5

Two silver iodobromide emulsions containing 1 mole% of silver iodide and having an average particle diameter of 0.06 micron were prepared. One of them was a sulfur sensitized emulsion chemically sensitized with N,N,N'-triethylthiourea, which was the same as that used in Examples 1 and 2. This emulsion was designated as S. The other emulsion was an emulsion sensitized with N,N,N'-triethylthiourea and chloroauric acid. This emulsion was designated as T.

The sensitizing dye and the sensitizing compound of this invention were added to these two emulsions as shown in Table 8.

Table 8

| Emulsion | (i) S | (ii) S | (iii) T |
|---|---|---|---|
| | (1 kg) | (1 kg) | (1 kg) |
| Sensitizing Dye 3-Allyl-5-[1-(2-carboxyphenyl)-2-(3-ethyl-2-thiazolinylidene)ethylidene] rhodanine | 100 mg | 100 mg | 100 mg |
| Sensitizing Compound 3 2,4-Di(hydroxylamino)-6-diethylamino-1,3,5-triazine | — | 250 mg | — |

Table 8-continued

| Emulsion | (i) S | (ii) S | (iii) T |
|---|---|---|---|
| | (1 kg) | (1 kg) | (1 kg) |
| Emulsion Designation after Addition of the above Compounds | U | V | W |

After the addition of these compounds, each of the Emulsions U, V and W was coated on a glass support and dried. The dry thickness of the coating was 5 microns. The resulting photographic material was subjected to sensitometric testing. The photographic material was exposed for one second to a tungsten-filament electric lamp through an optical wedge, and then developed with a developer solution having the same composition as that used in Example 1. The results of the test obtained are shown in Table 9.

Table 9

| | Sample U | V | W |
|---|---|---|---|
| Sensitivity | 1.0 | 1.8 | 1.8 |
| $\bar{G}$ (average gradient) | 4.4 | 5.3 | 3.4 |
| Fog | 0.02 | 0.02 | 0.03 |

The sensitivity shown in the above table was obtained by calculating the reciprocal of the amount of exposure required to obtain a photographic density of 2.0 above a fog value. The sensitivities of the Samples V and W are relative sensitivities with the sensitivity of Sample U being set at 1.0.

The average gradient $\bar{G}$ is the gradient of a straight line connecting two points which correspond to a photographic density of 0.1 and 2.0 (after subtraction of fog) on the characteristic curve.

The sensitivity of the Emulsion W which was chemically sensitized by the addition of the gold salt during chemical ripening increased to nearly two times that of the Emulsion U which was only sulfur sensitized and spectrally sensitized, but the average gradient of the Emulsion W was lower. The Emulsion V which was sensitized chemically with Compound 3 instead of the gold salt increased in sensitivity to the same degree as the Emulsion W, but had a higher average gradient. In the preproduction of fine line images, the use of Emulsion W does not lead to a sharp reproduction of the edges of the line image, but the use of the Emulsion V gives very sharp edges to the reproduced line image.

EXAMPLE 6

A fine silver iodobromide emulsion containing 2 mol% of silver iodide and having an average particle diameter of 0.10 micron was prepared.

Three kilograms of this emulsion were divided into three portions each weighing 1 kg, which were designated as Emulsions X, Y and Z. The compounds shown in Table 10 were added to Emulsions Y and Z.

Table 10

| Sample | Additive | Amount (mg) |
|---|---|---|
| X | None | — |
| Y | Triethylene Tetramine | 16 |
| Z | Compound 15 illustrated above | 15 |

Each of the emulsions was coated on a 0.13 mm thick cellulose triacetate film at a rate of 80 g/100 $cm^2$, and dried.

A portion of the film sample was allowed to stand for 7 days in an atmosphere at 40°C. and an RH of 80%. The films so treated and those which had not been treated at 40°C. were tested as to their sensitivity to a tungsten-filament electric lamp. A developer solution having the same composition as the developer solution used in Example 1 was used for the measurement of the sensitivity. The results obtained are shown in Table 11.

Table 11

| Sample | Treated at 40°C: Sensitivity | Fog | Not Treated Sensitivity | Fog |
|---|---|---|---|---|
| X | 1.0 | 0.07 | 1.0 | 0.03 |
| Y | — | 1.10 | 2.5 | 0.05 |
| Z | 2.2 | 0.07 | 2.2 | 0.03 |

Due to the addition of the tetraethylene tetramine, the emulsion Sample Y was sensitized markedly in comparison with emulsion Sample X, but it did not prove feasible because of great fog occurring during storage at high temperatures. The emulsion Sample Z not only increased in sensitivity to a greater degree than emulsion Sample X, but also barely exhibited any increase in fog or change in sensitivity during storage at high temperatures.

While the invention has been described in detail and in terms of specific embodiments thereof, it will be apparent that various changes and modifications can be made therein without departing from the spirit and scope thereof.

What is claimed is:

1. A silver halide photographic material comprising a support having thereon at least one photographic emulsion layer comprising silver halide particles having an average particle diameter not in excess of 0.35 micron or in which at least 90% of the total particles have a particle diameter not in excess of 0.4 micron, or having thereon at least one of said silver halide emulsion layers and at least one photographic emulsion layer comprising a hydrophilic polymeric material, wherein at least one of said photographic emulsion layers or said emulsion layer of a hydrophilic polymeric material contains a sensitizing amount of a heterocyclic organic compound represented by the formula (I):

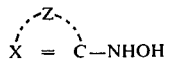

wherein X represents a nitrogen atom or a methine group and Z represents an atomic group necessary for forming a triazine ring which is part of a fused ring system, a pyrimidine ring or a pyrimidine ring which is part of a fused ring system.

2. The photographic material of claim 1, wherein said heterocyclic ring formed by Z is a triazine ring which is a part of a fused ring system.

3. The photographic material of claim 1, wherein said heterocylic compound has the following general formula (IIb):

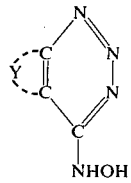

(IIb)

wherein Y represents a benzene ring.

4. The photographic material of claim 1, wherein said heterocyclic ring formed by Z is a pyrimidine ring.

5. The photographic material of claim 1, wherein said heterocylic compound has the following general formula (IIIa):

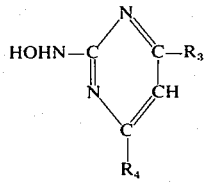

(IIIa)

wherein $R_3$ and $R_4$ each represents a hydrogen atom, a hydroxy group, an alkyl group, an alkoxy group, an aryl group, an amino group, an alkylamino group, or a hydroxyamino group.

6. The photographic material of claim 1, wherein said heterocyclic ring formed by Z is a pyrimidine ring which is a part of a fused ring system.

7. The photographic material of claim 1, wherein said heterocyclic compound has the following general formula (IIIb) or (IIIc):

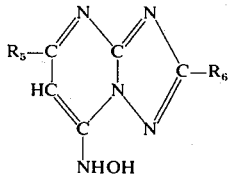

(IIIb)

wherein $R_5$ each represents a hydrogen atom, a hydroxy group, an alkyl group, an alkoxy group, an aryl group, an amino group, an alkylamino group, or a hydroxyamino group, and $R_6$ represents a hydrogen atom, an alkyl group, an aralkyl group or an aryl group:

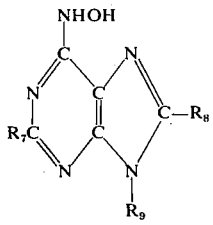

(IIIc)

wherein $R_7$ each represents a hydrogen atom, a hydroxy group, an alkyl group, an alkoxy group, an aryl group, an amino group, an alkylamino group, or a hydroxyamino group, and $R_8$ represents a hydrogen atom, an alkyl group, an aralkyl group or an aryl group, and $R_9$ represents a hydrogen atom, an alkyl group, an alkoxyalkyl group, an aralkyl group, or a hydroxy group.

8. The photographic material of claim 1, wherein said heterocyclic ring is a tetrazaindene ring.

9. The photographic material of claim 8, wherein said tetrazaindene ring is a 1,3,3a,7-tetrazaindene ring.

10. The photographic material of claim 1, wherein said heterocyclic compound is selected from the group consisting of compounds having the formulas

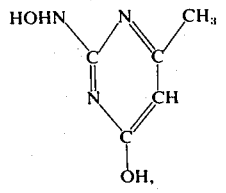

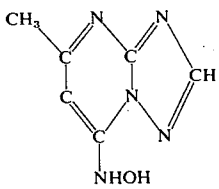

and

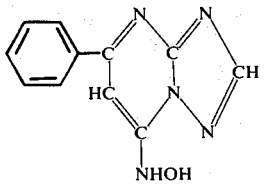

11. The photographic material of claim 1, wherein said silver halide is chemically sensitized.

12. The photographic material of claim 11, wherein said silver halide is sensitized by a noble metal sensitization, a reduction sensitization, a sulfur sensitization or a combination thereof.

13. The photographic material of claim 1, wherein the amount of said heterocyclic compound ranges from 10mg to 10g per mole of silver.

14. The photographic material of claim 13, wherein said amount ranges from 40mg to 3g per mole of silver.

15. The photographic material of claim 1, wherein said emulsion layer additionally contains a spectrally sensitizing organic compound.

16. The photographic material of claim 1, wherein said emulsion layer additionally contains a color coupler.

17. The photographic material of claim 1, wherein said silver halide is silver bromide or silver iodobromide.

18. The photographic material of claim 1, wherein said hydrophilic polymeric material is selected from organic compounds consisting of gelatin, polyvinyl alcohol, polyacrylic acid, polyacrylamide, copolymers of acrylic acid, or copolymers of acrylamide.

* * * * *